US008375617B2

(12) United States Patent
Brensinger

(10) Patent No.: US 8,375,617 B2
(45) Date of Patent: Feb. 19, 2013

(54) WEAPON PROTECTION DEVICE

(75) Inventor: Cam Brensinger, Arlington, MA (US)

(73) Assignee: Nemo Equipment, Inc., Dover, NH (US)

( * ) Notice: Subject to any disclaimer, the term of this patent is extended or adjusted under 35 U.S.C. 154(b) by 0 days.

(21) Appl. No.: 13/213,520

(22) Filed: Aug. 19, 2011

(65) Prior Publication Data

US 2012/0042558 A1 Feb. 23, 2012

Related U.S. Application Data

(63) Continuation-in-part of application No. 12/858,890, filed on Aug. 18, 2010.

(60) Provisional application No. 61/234,792, filed on Aug. 18, 2009.

(51) Int. Cl.
*F41A 35/02* (2006.01)

(52) U.S. Cl. ..... 42/96; 206/317

(58) Field of Classification Search ..... 42/96, 106; 206/317; 383/25, 67
See application file for complete search history.

(56) References Cited

U.S. PATENT DOCUMENTS

| | | | | | |
|---|---|---|---|---|---|
| 2,872,960 | A | * | 2/1959 | Kolpin | 206/317 |
| 2,913,030 | A | * | 11/1959 | Fisher | 206/317 |
| 3,191,652 | A | * | 6/1965 | Benson et al. | 206/317 |
| 3,239,114 | A | * | 3/1966 | Norsworthy | 206/317 |
| 3,437,247 | A | * | 4/1969 | Gantress | 206/317 |
| 3,540,508 | A | * | 11/1970 | Couch | 206/317 |
| 3,701,371 | A | * | 10/1972 | Stackhouse | 206/317 |
| 3,720,013 | A | * | 3/1973 | McDonald | 42/106 |
| 3,865,166 | A | * | 2/1975 | Pedro | 206/317 |
| 3,903,944 | A | * | 9/1975 | Montgomery et al. | 224/430 |
| 4,369,904 | A | * | 1/1983 | Christensen | 224/250 |
| 4,424,734 | A | | 1/1984 | Janssen et al. | |
| 4,489,833 | A | * | 12/1984 | Bauer | 206/522 |
| 4,754,498 | A | * | 7/1988 | Stinemates | 2/17 |
| 4,756,456 | A | * | 7/1988 | Schauer | 224/150 |
| 4,858,361 | A | * | 8/1989 | White | 42/96 |
| 4,860,479 | A | * | 8/1989 | Easter | 42/96 |
| 5,678,344 | A | * | 10/1997 | Jones et al. | 42/96 |
| 5,893,502 | A | * | 4/1999 | Redzisz | 224/577 |
| 6,119,388 | A | * | 9/2000 | Jones et al. | 42/96 |
| 6,256,922 | B1 | | 7/2001 | Jones et al. | |
| 6,691,693 | B1 | * | 2/2004 | Trussell, II | 124/25.6 |
| 6,722,496 | B2 | * | 4/2004 | Gantert | 206/315.11 |
| 6,874,628 | B2 | * | 4/2005 | Hammill | 206/317 |
| 7,185,607 | B1 | * | 3/2007 | Pearson | 42/96 |
| D562,549 | S | * | 2/2008 | Bodnar | D3/222 |
| 7,360,648 | B1 | * | 4/2008 | Blaschke | 206/317 |
| 7,905,350 | B2 | * | 3/2011 | Wood et al. | 206/317 |

(Continued)

OTHER PUBLICATIONS

International Search Report for PCT Application PCT/US2010/045893, Dec. 2, 2010, US PTO.

(Continued)

*Primary Examiner* — Benjamin P Lee

(74) *Attorney, Agent, or Firm* — Bourque and Associates, PA

(57) ABSTRACT

A weapon protection device designed to enclose a weapon and protect the weapon from adverse conditions, including water, dust, dirt and sand. The weapon protection device features a material that is durable and generally puncture resistant, impervious to water, lightweight, heat resistant and tear resistant. The weapon protection device is compact when not in use and requires very little storage space. The weapon protection device features one or more pockets having a flap and an interior region under the flap. The interior region is made of a flexible, stretchy material that allows a user to fire the weapon with either hand while the weapon is inside the protection device. The weapon can be used on short notice and does not require removal of the weapon from the weapon protection device. A waterproof opening seal, such as a dry sack seal, is provided.

20 Claims, 3 Drawing Sheets

U.S. PATENT DOCUMENTS

| | | | | |
|---|---|---|---|---|
| D636,180 | S * | 4/2011 | Sayre | D3/262 |
| 2003/0106819 | A1* | 6/2003 | Bennett | 206/317 |
| 2003/0201198 | A1* | 10/2003 | Gantert | 206/317 |
| 2004/0079660 | A1* | 4/2004 | Sauey et al. | 206/317 |
| 2004/0144664 | A1* | 7/2004 | Hammill | 206/317 |
| 2005/0123220 | A1* | 6/2005 | Smith | 383/106 |
| 2007/0294931 | A1* | 12/2007 | Kettles | 42/95 |
| 2010/0147425 | A1* | 6/2010 | Swain et al. | 150/166 |
| 2011/0259770 | A1* | 10/2011 | Debias | 206/317 |

OTHER PUBLICATIONS

International Preliminary Report on Patentability, Feb. 21, 2012, WIPO.

* cited by examiner

WEAPON PROTECTION DEVICE

CROSS-REFERENCE TO RELATED APPLICATIONS

This application is a continuation-in-part of U.S. patent Ser. No. 12/858,890 which was filed on Aug. 18, 2010 and claims priority from U.S. Provisional Patent Application No. 61/234,792 Aug. 18, 2009, both of which are incorporated fully herein by reference.

TECHNICAL FIELD

The present invention relates to weapon protection in adverse field conditions caused by weather and the environment and more particularly, to a weapon protection device that covers and protects a weapon while still allowing a user to fire the weapon while the weapon is inside the weapon protection device.

BACKGROUND

Weapons are often used in adverse conditions. Weapons can include, but are not limited to, firearms or any other weapons with intricate or mechanically precise firing mechanisms that could be compromised by sand, salt, or other environmental contaminants including bows (particularly compound bows and crossbows), spearguns, tasers, paintball guns, etc. (collectively referred to herein as weapons). The adverse conditions that these weapons are exposed to can include salt or fresh water, chemicals, dust, sand and other particulates or types of contaminants. These adverse conditions can damage the weapon and lead to malfunction, or precipitate the need for premature maintenance and repair. At a minimum, damage can lead to expense or lost time while at worst, damage can cause a weapon to fail to perform properly and compromise the safety of a soldier or police officer who is relying on the weapon being ready to be used at a moment's notice. This is especially of concern to soldiers, whose areas of operation might include deserts, high mountains and ocean or other wet environments, where the environment may be especially harsh and compromising to the reliability of their weapons.

Pistols, rifles and fully automatic weapons typically include a hollow tubular barrel, are trigger initiated and hand held. When necessary, the weapon needs to be readily accessible to the user. Under certain circumstances, it is desirable to carry a firearm in a water and\or dust proof protective bag. The bag is typically comprised of a waterproof material and the weapon is completely sealed within the bag, which may or may not closely fit the shape of the weapon. The user cannot see the weapon inside the bag and cannot use the weapon while it is inside the bag. The bag typically contains a zipper or other opening means and the weapon must be removed from the bag in order for the weapon to function.

Improvements on such a waterproof duffle bag weapon holder have been made that allow a user to protect a weapon from water and sand and still allow the weapon to be fired. The current technology consists of a neoprene bag that has a brass waterproof zipper and a built-in five-finger glove-like pocket "welded" onto the side of the bag. To fire a weapon, a user must first locate and then insert their hand into the glove-like pocket in order to operate the trigger. The glove-like pocket does not allow for ambidextrous use. The pocket can be hard for the user to locate and then difficult to slide their hand into, especially for large or small hands or if the bag or user's hand is wet, covered with sand or otherwise contaminated. Furthermore, it can be difficult to operate features of the weapon once the hand is inserted.

Some features such as the weapon's foregrip, magazine or cocking mechanism may be out of reach of the built in "glove". Moreover, such prior art bags completely preclude the use of the weapon's build in sight, such as a laser or other sight. Additionally, the prior art bags are expensive, bulky and weigh approximately 3 pounds when dry and empty. When the bag is removed after adverse conditions have passed, the user must store the bag, which can be even heavier and bulkier when wet.

Furthermore, the bag is opaque and the user cannot see the weapon while the bag is covering the weapon, so it is not possible to visually inspect the weapon for the position of the safety, cocking mechanism, or proper seating of a magazine. These bags also require regular maintenance, such as the addition of a wax to maintain the waterproof quality of the brass zipper.

As such, there is a need to improve upon the prior art to create a weapon protective device (bag) that is lightweight and easy to store, which protects the weapon, and allows for simple ambidextrous use of all of the critical features of the weapon (preferably including any sighting mechanism) regardless of hand size and which hand is used to operate the weapon, when the weapon is contained and protected within the device. Additionally, the weapon protection device should be sufficiently durable such that the weapon protection device cannot be punctured, ripped or torn when used in harsh environmental conditions.

SUMMARY OF THE INVENTION

The present invention features a novel apparatus for the protection of a weapon from adverse conditions. The weapon protection device allows for transportation of the weapon through wet or dirty environments while still allowing a user to visually inspect, manipulate and fire the weapon in a natural and instinctual way. The weapon protection device of the present invention is made from a clear or translucent highly durable and lightweight film material, which allows the weapon to be easily visible to the user, but may also have a dark tint and/or matte finish if camouflage or low-reflectivity is necessary. The weapon protection device is impervious to water, is low cost and is extremely lightweight.

The film material is preferably a relatively thin, durable material that is strong enough to withstand reasonable abrasion and puncture. Two "pockets" are provided: one on each side of the weapon protection device. These "pockets" flare outwardly somewhat and are made of the same thin, durable material as the remainder of the device. The interior region of the weapon protection device under the "pocket" is, however, made of a stretchy film material which, although less durable, is covered with not in use by the pocket or flap. The stretchy film material allows the user to grip and operate the trigger mechanism of the weapon stored within the weapon protection device.

When not in use, the weapon protection device is very compact and can be folded or rolled into a very small size to fit in a typical cargo pants or jacket pocket. The weapon protection device allows the user to utilize the weapon contained therein by either the left or the right hand of the user. The weapon protection device is designed to be a shoot-through device that is simple to use, is low cost and disposable. The weapon protection device allows the weapon to be used on short notice, when there is not enough time to remove it from the weapon protection device.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention and not to be limited except by the allowed claims and their legal equivalents.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
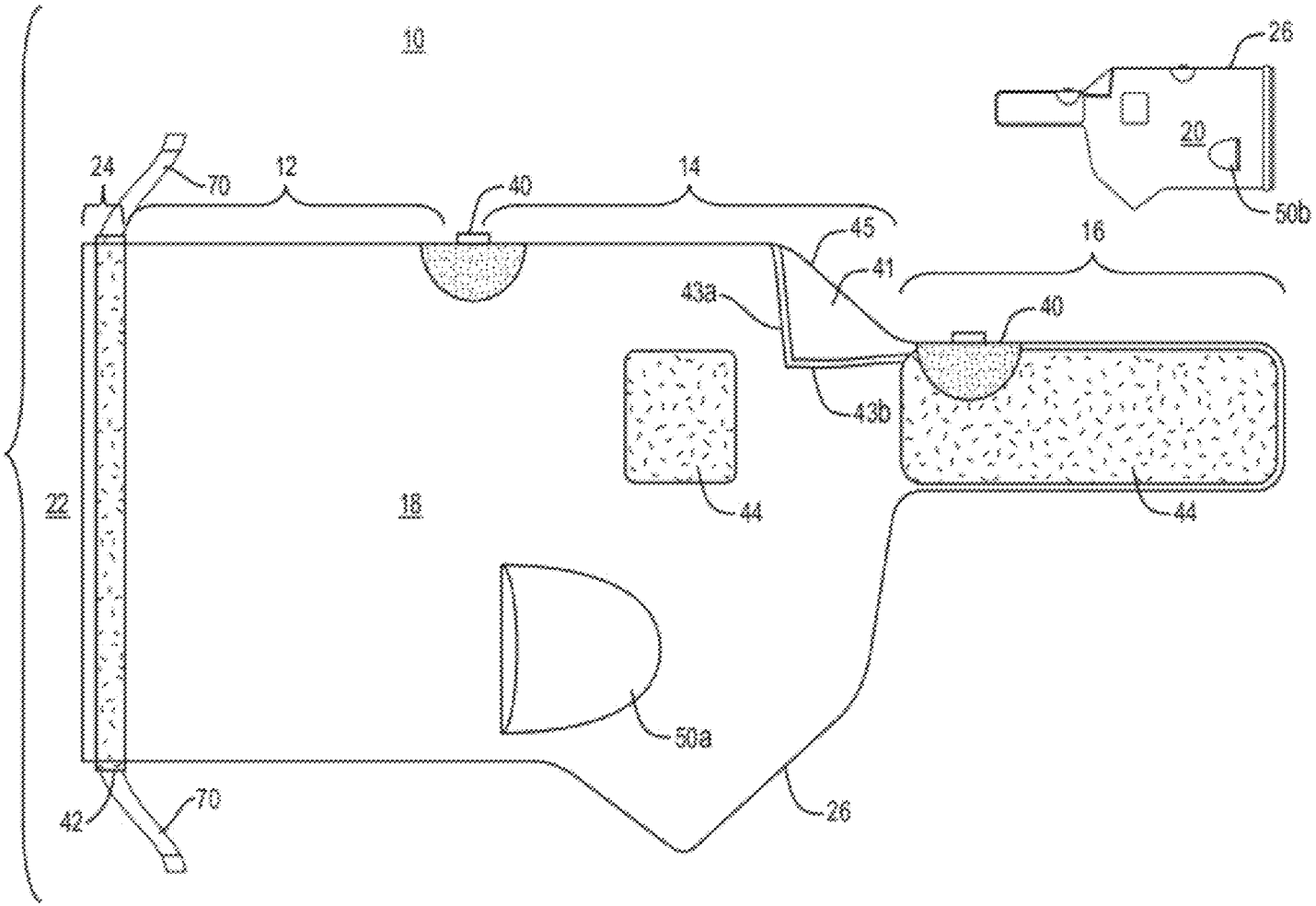
FIG. 1. is a perspective view of a protection device according to the present invention.
Figure 2:
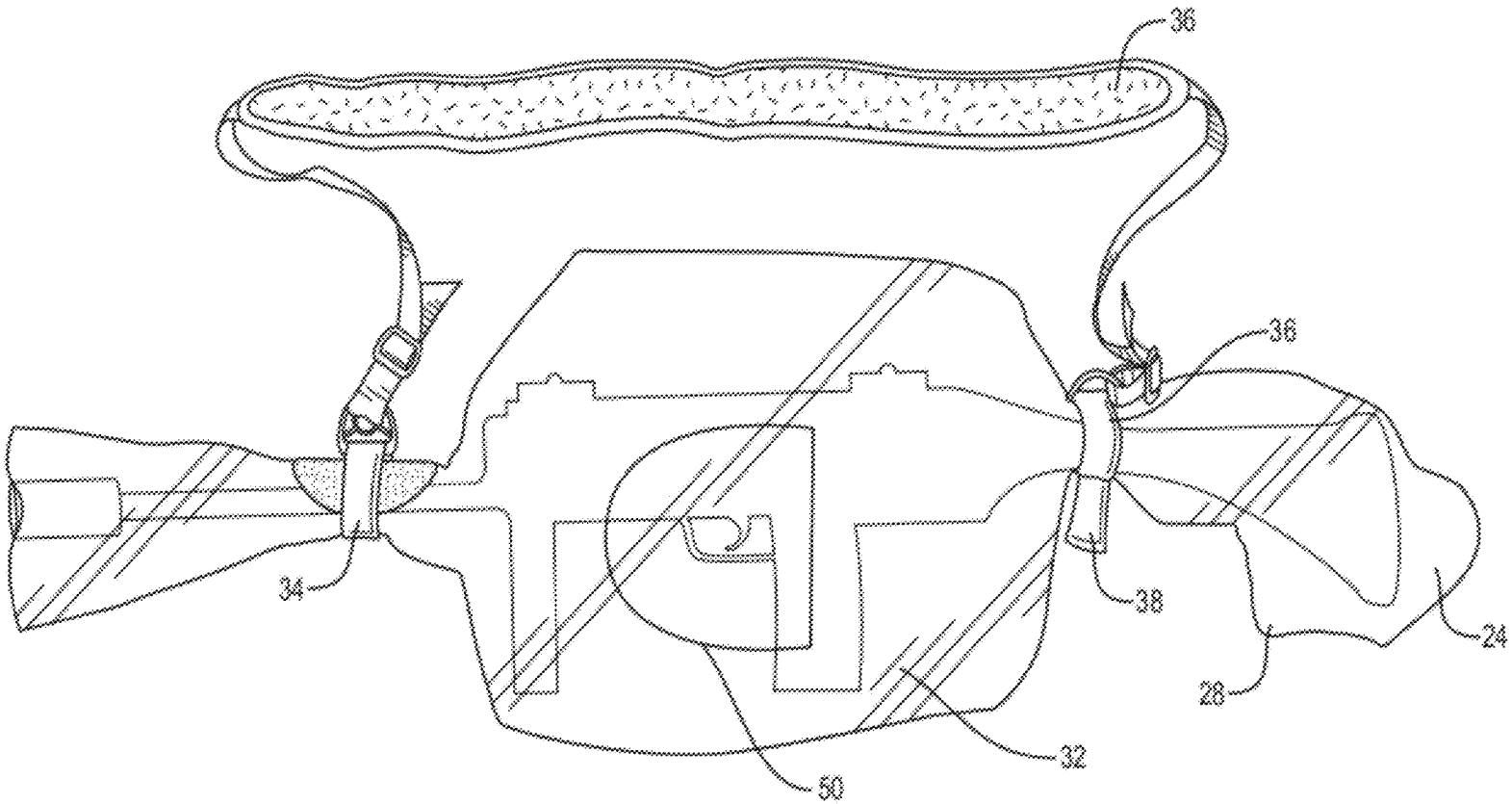
FIG. 2 is a perspective view of a protection device of the present invention shown with a weapon inside the protective device.
Figure 3:
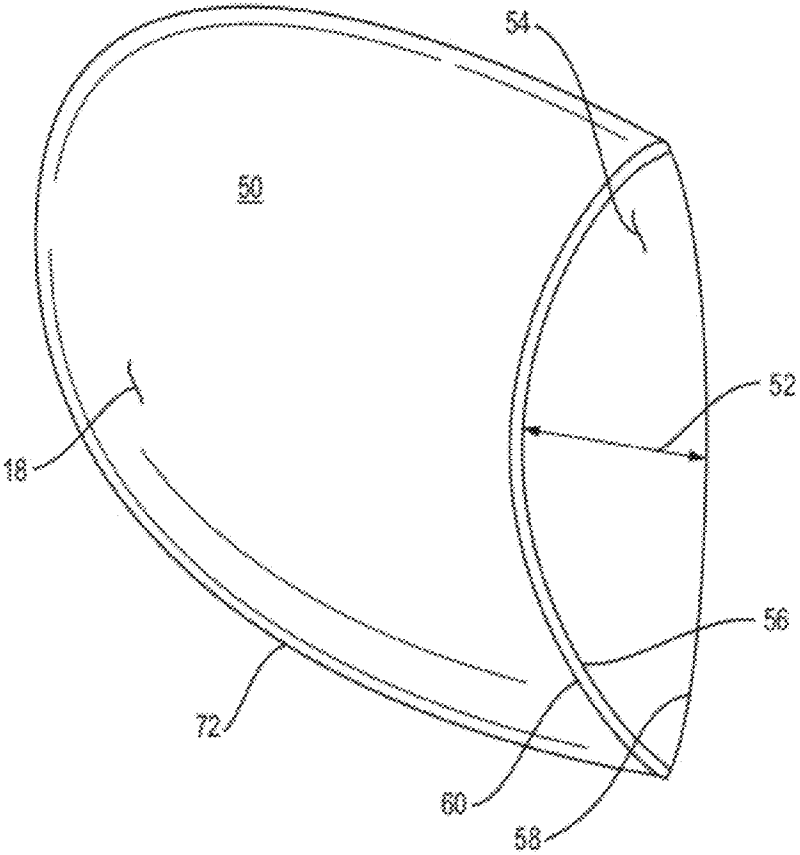
FIG. 3 is a perspective view of the pocket or flap according to the present invention.

The weapon protection device 10, FIG. 1, in accordance with the present invention includes a first side 18 and a second side 20. The weapon protection device 10 of this embodiment of the present invention is constructed by the connection of the first side 18 and the second side 20 as will be discussed in greater detail below. The first side 18 and second side 20 are completely sealed to one another except for an opening 22. The opening 22 allows for entry and removal of the weapon (the weapon is shown in FIG. 2). Each of the sides 18/20 consists of a stock portion or region 12 that contains the stock of the weapon, a body, handle and trigger portion or region 14, a barrel portion or region 16 and a pocket 50.

The weapon protection device 10 is preferably made from a highly durable and lightweight material, such as 420 denier nylon or any other suitable material. The 420 denier nylon fabric is coated with 1.5 ounces of polyurethane having a melt point of approximately 300 degrees and making the coated fabric RF, sonic or heat "weldable". The fabric is thus abrasion and heat resistant.

The fabric may be single side coated or more preferably double side coated. The fabric may be only single side coated in certain areas, such as in the muzzle area or region 16, in order to provide additional heat resistance in those areas other areas.

The fabric material is therefore heat resistant, as well as being tear resistant and abrasion resistant. The materials used for the first and second side are preferably lightweight. The material used for the sides 18/20 can be a dark translucent material with a matte finish that is non-reflective or can be an opaque material, or alternately any other material as needed in various environmental situations, such as black, clear, or camouflage.

The preferred manufacturing method for the weapon protection device is by radio frequency (RF) heat welding or sonic welding, although other manufacturing methods are contemplated and within the scope of the current invention. The polyethylene material used for the sides 18/20 allows for a "peel type" heat welded seam or other sealing method around a perimeter 26 of the weapon protection device 10.

In accordance with one feature of the present invention, each side 18/20 also features a pocket 50*a*/50*b*, FIG. 1. The pockets 50*a*/50*b* are located within or proximate the trigger portion or region 14 of the weapon protection device 10. The pockets 50 allow a user to place their hand in through an opening 52 into an internal cavity 54. The internal cavity 54 is formed by a first side 56, and a second side 58. When a user's hand is inside the internal cavity 54, the user can access a trigger device of a weapon and fire the weapon by placing the palm of their hand and fingers against the second side 58 of the internal cavity 54. It is also contemplated and within the scope of the invention that the weapon protection device 10 would feature only one pocket, either on the first side 18 or second side 20, although the provisions of the two pockets 50 make the weapon storage device ambidextrous and not just left or right handed.

The first side 56 of each pocket is made from the same durable, lightweight material as the remainder of the device 10 coated at least on the inside to make it weldable to the remainder of the side 18 or 20. The material forming the inside 58 of each of the pockets 50, is preferably a stretchable yet relatively strong, lightweight, inexpensive, weatherproof, durable, heat weldable material such as a stretchable plastic or composite material. The stretch film material is preferably a polyurethane stretchable material, such as a thermoplastic polyurethane (TPU) film. The preferred material for this film is a 7 mil thermoplastic polyurethane available from American Polyfilm, Inc. for example. The stretchiness of the material forming the inside of the cavity 58 allows the inside material 58 of the weapon protection device 10 to conform to the shape of the weapon's handle and allows full gripping and use of the weapon's mechanical features. The stretch film material 58 may be transparent or translucent, but this is not intended to be a limitation of the present invention.

The material of the first side 56 of the pocket 50 is preferably a 420 denier nylon material coated at least on the inside with polyethylene as used in the manufacture of the remainder of the protection device 10, in order to facilitate a weld along line 72 between the pocket 50 and the sides 18/20 of the weapon protection device 10.

The weapon protection device 10 may include any of the features described in connection with the weapon protection device 10 of the parent application. These devices may include but are not limited to, a plurality of strap attachment areas for gathering up loose material and/or for facilitating carrying of the weapon protection device, a transparent window for viewing the laser sight, and one or more portions on the inside of the weapon protection device 10 that are lined with or include a heat resistant component. Each of these additional features were previously discussed in detail above with respect to the weapon protection device 10 disclosed in the parent application. And incorporated herein by reference.

For example, the weapon protection device 10 may be outfitted with a plurality of strap attachment areas 40. Each strap attachment area 40 can be outfitted with a strap as will be discussed in greater detail below.

The weapon protection device 10 can be folded or rolled or similarly collapsed into a very small package and secured together with one of the provided clips and that fits easily into a user's pocket or into another similarly small space, thereby allowing for easy storage and transport when not in use. The material of the weapon protection device 10 is sufficiently strong enough to be suitable for use in adverse weather conditions and also in rugged or rough terrain, where the bag is subjected to protruding objects and irregular terrain, such as when a user deploys from an aerial vehicle into dense forest or other terrain.

The weapon protection device 10 preferably features a closure mechanism 24 that allows for complete closure of the opening 22 once a weapon is inserted into the weapon protection device 10. The opening 22 is large enough to allow for a weapon with an extended magazine and/or optics and sighting devices. The closure mechanism 24 is preferably a dry bag closure as is well known in the art although other waterproof and sand proof closures are within the scope of the invention. In order to facilitate closure of the opening 22, the weapon is inserted into the weapon protection device 10 with the barrel of the weapon entering the barrel portion 16 of the weapon protection device 10.

As is well known in a dry bag closure device, the length of the opening on both the first side 18 and second side 20 is outfitted with a rigid strip of material 42 that allows the material of the weapon protection device 10 to easily fold over in a predetermined length during the rolling and closing of the dry bag style closure 24. The material of the weapon protection device 10 near the opening 22 is folded at least once during closure. Preferably, the material is folded a minimum of three times in order to ensure that water and other debris cannot enter the weapon protection device 10 as is commonly done with similar waterproof closure devices.

Finally, a buckle 70 is snapped together to maintain the dry bag style closure 24 or other airtight seal in a closed position, to maintain an airtight seal that is impervious to penetration by water and other substances. The buckle 70 also serves to hold the weapon protection device 10 in a closed position once rolled up. The buckle 70 may be made of plastic, metal, or a composite material. The dry bag style closure is intuitive and maintenance free. Other suitable closure mechanisms may also be employed.

The design of the weapon protection device 10 is such that upon closure of the dry bag style closure mechanism 24, a certain amount of air is trapped within the weapon protection device 10. This trapped air serves multiple functions. First, the air provides buoyancy should a user lose control of the weapon and protection bag in water, wherein the air will prevent the weapon from sinking. Second, the excess air also provides space around the receiver and ejector port of the weapon for spent shell casings.

In addition, the trapped air helps to force the pockets 50 into a more open state. This is accomplished by the pressure of the trapped air pushing against the opening 52 of the pockets 50 in conjunction with a flexible pocket band 60. The flexible pocket band 60 is located at or near the opening 52 of the pocket 50. The flexible pocket band 60 may be one-piece of material or may be multiple pieces of material. The flexible pocket band 60 is preferably constructed from a plastic or other similar semi-rigid material. When the opening 22 is open and the closure mechanism 24 is not engaged, the weapon protection device 10 lies essentially flat and the flexible pocket band 60 also lies essentially flat and generally parallel to the opening 22, thereby allowing for easy folding and storage of the weapon protection device 10.

When the opening 22 is closed and the closure mechanism 70 is engaged and air is trapped within the weapon protection device 10, the flexible pocket band 60 is forced or tends to bend or flex or bow slightly outwardly, thereby enlarging access to the pocket opening 52 by pushing the first opening edge 56 away from the second side or edge 58. This enlarged opening facilitates easy entry of a user's hand into the internal cavity 54 of the pocket 50.

After the weapon protection device 10 opening 22 has been closed, the weapon protection device 10 may be further fitted or conformed to the weapon. A first strap 34, which is attached to one of a plurality of strap attachment areas 40, is preferably located in the barrel portion 16 of the weapon protection device 10. The first strap 34 is used to gather excess material in the weapon protection device 10 around the weapon barrel and to hold the weapon in place within the weapon protection device 10. The first strap 34 preferably consists of a hook and loop fastener or similar attachment means to which is attached a short length of webbing or pull strap 38 which serves as a pull tab to allow the operator to quickly release the hook and loop fastener if and when it is desired to remove the weapon from within the weapon protection device 10.

A second strap 36, which is similarly designed and attached to one of a plurality of strap attachment areas 40, may be located between the handle portion 12 and body and trigger portion 14 of the weapon protection device 10. The second strap 36 is also used to gather excess material in the weapon protection device 10 and to hold the weapon in place within the weapon protection device 10, and is similarly secured using a hook and loop fastener or a similar attachment means to which is attached a short length of webbing or strap 38 that serves as a pull to release the strap 36. The depiction of the weapon protection device 10 in FIG. 2 shows the weapon protection device 10 when the first strap 34 and second strap 36 are securely positioned around the weapon 32. Additional or fewer straps may be employed as is necessary. Various sizes and styles of bags are envisioned by the present embodiment, to provide protection to firearms or weapons of all types, shapes and sizes.

The weapon protection device 10 may further include a shoulder strap 30 that provides for ease of carrying the weapon protection device 10 and weapon 32. Additionally, all or only a portion of the inside of the weapon protection device (for example, the area at or near the barrel portion 16) may be lined with and/or made from a heat resistant component 44 in one or more places, in order to protect the material of the weapon protection device 10 from heat given off by the weapon when the weapon is fired. The heat resistant components 44 may be located at or near the end of the gun barrel near the flash suppressor and/or in other regions as necessary. The heat resistant panels/components allow sustained firing of the weapon without melting the TPU film bag to the weapon and creating a big mess and perhaps making the weapon inoperative.

The heat resistant panels/components 44 may be made of nylon, Nomex™ fabric, or any other suitable fabric that provides for and is heat resistant and also weldable by RF, heat, sonic or other means. In a preferred embodiment of the present invention, these fabrics would be coated with polyurethane and welded onto the inside of the weapon protection device.

The preferred manufacturing method for the weapon protection device is by radio frequency (RF) or heat or sonic welding a few simple pattern pieces which provides an excellent economy of scale, manufacturing efficiency and predictable quality compared to the relatively large number of pattern pieces needed to be stitched together in the prior art. Welding can be an automated process, versus stitching which is a manual process and more prone to errors and inaccuracy. Also, automated processes tend to become cheaper faster as quantities increase. The low cost of the bag also means it can be treated more like a disposable item, so that if it wears out or damage is suspected, it can be replaced easily and inexpensively and the user is less likely to extend the use of a bag in questionable condition if price and availability are not an issue.

The fabric or material used to manufacture the device is preferably transparent or translucent at least in certain regions. The transparency of the weapon protection device allows a user to see the weapon inside the weapon protection device and allows for visual inspection of the weapon prior to or during use. The translucent film allows for visual inspection but also obscures the view of the weapon from a distance, which may be desirable. The transparency of the film material (either throughout the entire bag or in one or more specific areas such as area 41 41 as will be explained below) may also allow a laser sight or other projection type sighting device installed on the weapon to remain functional. The main film of the bag would preferably be a dark translucent material with a matte finish that is non-reflective. An opaque material could also be used if visual inspection is not desired, without impairing the basic virtue of this design, which is to allow a natural and instinctual manipulation of the weapon in a lightweight and low cost device.

In the preferred embodiment, the weapon protection device 10 includes a transparent "window" 41 that allows a laser sight or other projection type sighting device on the weapon to remain functional. The transparent window 41 allows the "projection" (i.e. laser beam from a laser sight) from the sight to project "through" the transparent window 41 and function essentially as it would without the weapon protection device 10.

In order to achieve this functionality, the transparent window 41 is made by folding a piece of transparent material forming a fold line 45 and two welded edges 43*a* and 43*b*. The two edges 43*a* and 43*b* are welded to the adjacent material of the first and second sides 18 and 20 respectively of the weapon protection device 10. Eliminating any welded edge along line 45 ensures that there is not unnecessary material, welding, weld joint and the like that might serve to interfere with the laser or other projection sighting device.

The weapon protection device 10 is extremely lightweight compared to prior art versions that weigh in excess of 2 pounds. The weapon protection device 10 would preferably weigh approximately 5-10 ounces. The weapon protection device 10 can be folded or rolled or similarly collapsed into a very small package and secured together with one of the provided clips and that fits easily into a pocket or into another similarly small space. The diminutive size of the weapon protection device when in a folded state allows for easy storage and easy transport when not in use. A folded or rolled weapon protection device can fit easily into a cargo pants pocket of the user.

The weapon protection device 10 allows for full operation of the weapon without the need for an integrated glove. The simplicity of the weapon protection device saves cost and weight and reduces manufacturing complexity and the possibility for leaks. The material of the weapon protection device allows for stretching so that there is no glove required as the users hand can be placed on the outside of the bag around the area of the trigger or other components or features and the material allows for enough stretch so that the user can pull the trigger or manipulate other features of the weapon.

It is understood that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention and not to be limited except by the allowed claims and their legal equivalents.

What is claimed is:

1. A weapon protection enclosure device, comprising:

an enclosure comprising a pliable, waterproof and abrasion-resistant material and having a first side, a second side, a first end and a second end, said enclosure configured for containing a weapon entirely within an interior cavity of said enclosure;

said first side and said second side of said enclosure coupled to one another proximate an edge region, said coupled first and second sides including an edge region proximate said first end of said enclosure wherein said edge region is not coupled together, said first end region configured for forming an opening into said enclosure, said opening being the only opening into said enclosure; said enclosure opening provided with a waterproof closure device;

said enclosure defining a weapon barrel portion, configured for receiving a weapon barrel, a weapon stock portion, configured for receiving a stock portion of a weapon, and a weapon body portion, configured for receiving a body, handle and trigger portion of said weapon; and at least one pocket, disposed on at least one of said first and second sides in said weapon body portion of said enclosure, and configured for allowing a user to place their hand into the pocket, said pocket including a top flap portion constructed of said pliable, waterproof and abrasion-resistant material of said enclosure and attached to said at least one of said first and second sides about a partial periphery of said flap leaving a non-adhered periphery portion, said not adhered periphery portion forming an opening under said flap, and said pocket including an interior region disposed under said flap, said interior region constructed of a stretchable fabric like material and configured for allowing a user's hand to stretch said stretchable fabric like material around a weapon portion disposed under or near said interior region, wherein said user can manipulate said trigger portion of said weapon while said user's hand is inside said pocket without accessing said interior cavity of said enclosure.

2. The weapon protection enclosure device of claim 1, wherein said enclosure material is a 420 denier nylon material that is polyethylene coated on at least one side.

3. The weapon protection enclosure device of claim 1, wherein said waterproof closure device includes a dry sack style closure.

4. The weapon protection enclosure device of claim 1, wherein said enclosure device is configured for enclosing a firearm weapon.

5. The weapon protection enclosure device of claim 1, wherein said firearm includes an automatic firearm.

6. The weapon protection enclosure device of claim 1, wherein said barrel portion of said enclosure includes at least one region including a heat resistant material.

7. The weapon protection enclosure device of claim 6, wherein said barrel portion includes said heat resistant material.

8. The weapon protection enclosure device of claim 6, wherein said barrel portion is constructed from said heat resistant material.

9. The weapon protection enclosure device of claim 1, wherein said enclosure includes a plurality of enclosure gathering devices.

10. The weapon protection enclosure device of claim 1, wherein said body portion of said enclosure further includes a projection sight penetrating window, configured for allowing a projected signal from a projected weapon sight to exit said enclosure for use as a projection sight signal.

11. The weapon protection enclosure device of claim 10, wherein said projection sight penetrating window includes a clear window formed by folding a clear piece of heat weldable material, said window including a central portion and heat weldable edges, wherein said projection sight penetrating window is configured so as to allow said projected signal to pass through said central portion of said projection sight penetrating window without having to pass through said heat weldable edges of said projection sight penetrating window.

12. The weapon protection enclosure device of claim 1, further including first and second pockets, said first pocket disposed on said first side of said enclosure in said weapon body portion, and said second pocket disposed on said second side of said enclosure in said weapon body portion.

13. The weapon protection enclosure device of claim 1, wherein said at least a first pocket include a stiffening member disposed in said non-adhered periphery portion of said top flap portion.

14. A weapon protection enclosure device, comprising:

an enclosure comprising a heat weldable, pliable, waterproof and abrasion resistant material, said material including at least a single sided polyethylene coating, said enclosure device having a first side, a second side, a first end and a second end, said enclosure configured for containing a weapon entirely within an interior cavity of said enclosure;

said first side and said second side of said enclosure heat welded to one another proximate an edge region, said coupled first and second sides including an edge region proximate said first end of said enclosure wherein said edge region is not coupled together, said first end region configured for forming an opening into said enclosure, said opening being the only opening into said enclosure, said opening provided with a dry sack type waterproof closure device;

said enclosure defining a weapon barrel portion, configured for receiving a weapon barrel, wherein said barrel portion of said enclosure includes at least one region including a heat resistant material, a weapon stock portion, configured for receiving a stock portion of a weapon, and a weapon body portion, configured for receiving a body, handle and trigger portion of said weapon; and first and second pockets, configured for allowing a user to place their hand into said pockets in order to manipulate said trigger portion of said weapon, said first pocket disposed on said first side of said enclosure in said weapon body portion, and said second pocket disposed on said second side of said enclosure in said weapon body portion, said first and second pockets including a top flap portion constructed of said pliable, waterproof and abrasion-resistant material of said enclosure and attached to said enclosure about a partial periphery of said flap forming a non-adhered periphery portion, said not adhered periphery portion forming an opening under said flap, and said first and second pockets including an interior region disposed under said flap, said interior region constructed of a stretchable fabric like material and configured for allowing a user's hand to stretch said stretchable fabric like material around a weapon portion disposed under or near said interior region, wherein said user can manipulate said trigger portion of said weapon while said user's hand is inside said pocket without accessing said interior cavity of said enclosure.

15. The weapon protection enclosure device of claim 14, wherein said material is a 420 denier nylon material that is at least single sided polyethylene coated.

16. The weapon protection enclosure device of claim 14, wherein said material is a 420 denier nylon material that is double sided polyethylene coated.

17. The weapon protection enclosure device of claim 14, wherein said dry sack type waterproof closure device is configured to trap air within said enclosure when said dry sack type waterproof closure device is engaged.

18. The weapon protection enclosure device of claim 17, wherein said trapped air within said enclosure causes said opening of said pocket to protrude outward, away from said side of said enclosure.

19. The weapon protection enclosure device of claim 14, wherein each of said first and second pockets include a stiffening member disposed in said non-adhered periphery portion of said top flap portion.

20. A weapon protection enclosure device, comprising:

an enclosure comprising a pliable, waterproof and abrasion-resistant material and having a first side, a second side, a first end and a second end, said enclosure configured for containing a weapon entirely within an interior cavity of said enclosure;

said first side and said second side of said enclosure coupled to one another proximate an edge region, said coupled first and second sides including an edge region proximate said first end of said enclosure wherein said edge region is not coupled together, said first end region configured for forming an opening into said enclosure, said opening being the only opening into said enclosure; said enclosure opening provided with a waterproof closure device;

said enclosure defining a weapon barrel portion, configured for receiving a weapon barrel, a weapon stock portion, configured for receiving a stock portion of a weapon, and a weapon body portion, configured for receiving a body, handle and trigger portion of said weapon, wherein said weapon body portion of said enclosure further includes a projection sight penetrating window, configured for allowing a projected signal from a projected weapon sight to exit said enclosure for use as a projection sight signal, and further wherein said projection sight penetrating window includes a clear window formed by folding a clear piece of heat weldable material, said clear window including a central portion and heat weldable edges, wherein said projection sight penetrating window is configured so as to allow said projected signal to pass through said central portion of said projection sight penetrating window without having to pass through said heat weldable edges of said projection sight penetrating window; and at least one pocket, disposed on at least one of said first and second sides in said weapon body portion of said enclosure, and configured for allowing a user to place their hand into the pocket, said pocket including a top flap portion constructed of said pliable, waterproof and abrasion-resistant material of said enclosure and attached to said at least one of said first and second sides about a partial periphery of said flap leaving a non-adhered periphery portion, said not adhered periphery portion forming an opening under said flap, and said pocket including an interior region disposed under said flap, said interior region constructed of a stretchable fabric like material and configured for allowing a user's hand to stretch said stretchable fabric like material around a weapon portion disposed under or near said interior region, wherein said user can manipulate said trigger portion of said weapon while said user's hand is inside said pocket without accessing said interior cavity of said enclosure.

* * * * *